US009822960B2

(12) United States Patent
Kwok et al.

(10) Patent No.: US 9,822,960 B2
(45) Date of Patent: Nov. 21, 2017

(54) OMNIDIRECTIONAL SOLID-STATE LAMPS

(71) Applicants: Leo Yuen-Lok Kwok, Milpitas, CA (US); Xinhan Shen, Foshan (CN)

(72) Inventors: Leo Yuen-Lok Kwok, Milpitas, CA (US); Xinhan Shen, Foshan (CN)

(73) Assignee: Leo Kwok, Milpitas, CA (US)

( * ) Notice: Subject to any disclaimer, the term of this patent is extended or adjusted under 35 U.S.C. 154(b) by 0 days.

(21) Appl. No.: 14/715,359

(22) Filed: May 18, 2015

(65) Prior Publication Data

US 2016/0102849 A1 Apr. 14, 2016

(30) Foreign Application Priority Data

Oct. 10, 2014 (CN) ..... 2014 2 0585135 U

(51) Int. Cl.

| | |
|---|---|
| ***F21V 19/00*** | (2006.01) |
| ***F21V 15/02*** | (2006.01) |
| ***H01R 33/22*** | (2006.01) |
| ***F21V 23/04*** | (2006.01) |
| ***F21V 14/00*** | (2006.01) |
| ***F21K 9/232*** | (2016.01) |
| *F21V 3/00* | (2015.01) |
| *F21Y 115/10* | (2016.01) |
| *F21Y 107/20* | (2016.01) |
| *F21Y 107/40* | (2016.01) |

(52) U.S. Cl.

CPC ..... *F21V 23/04* (2013.01); *F21K 9/232* (2016.08); *F21V 14/00* (2013.01); *F21V 3/00* (2013.01); *F21Y 2107/20* (2016.08); *F21Y 2107/40* (2016.08); *F21Y 2115/10* (2016.08)

(58) Field of Classification Search

CPC . F21Y 2107/20; F21Y 2107/40; H01R 33/20; H01R 33/205; H01R 33/22

See application file for complete search history.

(56) References Cited

U.S. PATENT DOCUMENTS

| | | | | |
|---|---|---|---|---|
| 551,357 | A * | 12/1895 | Beal | H05B 37/029 200/51.06 |
| 712,149 | A * | 10/1902 | Paiste | H01R 33/94 200/51.03 |
| 860,325 | A * | 7/1907 | Phelps | H05B 35/00 200/18 |
| 2,203,762 | A * | 6/1940 | Zagmester | H01R 33/94 174/17.08 |
| 7,905,626 | B2 * | 3/2011 | Shantha | H01J 5/54 362/228 |
| 8,304,971 | B2 * | 11/2012 | Huang | F21V 29/77 313/44 |
| 8,653,723 | B2 * | 2/2014 | Cao | F21V 3/00 313/45 |
| 9,127,827 | B2 * | 9/2015 | Kim | F21K 9/1355 |
| 2006/0193130 | A1 * | 8/2006 | Ishibashi | F21V 29/67 362/227 |

(Continued)

*Primary Examiner* — Ismael Negron

(74) *Attorney, Agent, or Firm* — James M. Wu; JW Law Group

(57) ABSTRACT

A light emitting diode ("LED") light fixture includes a base including contacts for connecting to an electrical power supply, a plurality of LED disposed on a stand coupled to the base, and a protective shell coupled to the base for protecting the stand from being contacted by a foreign object. The LED stand might be an elongated spherical shaped ball, or a polygonally shaped prism.

8 Claims, 9 Drawing Sheets

(56) References Cited

U.S. PATENT DOCUMENTS

| | | | | |
|---|---|---|---|---|
| 2012/0170288 | A1* | 7/2012 | Lai | F21K 9/90 362/373 |
| 2012/0218737 | A1* | 8/2012 | Komatsu | F21V 3/00 362/84 |
| 2013/0240920 | A1* | 9/2013 | Lin | F21K 9/232 257/89 |
| 2015/0285487 | A1* | 10/2015 | Kochanski | H01R 33/22 362/235 |

* cited by examiner

OMNIDIRECTIONAL SOLID-STATE LAMPS

PRIORITY

This patent application is a continuation-in-part (CIP) patent application of a Chinese patent application Ser. No. 201420585135.4, filed Oct. 10, 2014, entitled "All-dimensional LED Bulb Lamp without Dark Spots," the disclosure of which is incorporated herein by reference.

FIELD

The exemplary aspect(s) of the present invention relates to lighting devices. More specifically, the aspect(s) of the present invention relates to light radiation emitted by a solid-state light apparatus using light-emitting diode ("LED") device.

BACKGROUND

With increasing efficiencies, versatility, and capabilities in semiconductor illuminating technology, solid-state light emitting devices such as LEDs are in a process of replacing traditional incandescent and/or fluorescent light bulbs for general illumination. With continuing development of LEDs, LEDs will have higher light conversion efficiencies and less energy consumption. An advantage of using the LEDs for general illumination is that they are more energy efficient, compact, and reliable in comparison with traditional lighting fixtures such as incandescent or fluorescent light bulbs or lamps.

To adopt solid-state lighting source such as LED for commercial as well as residential application, LED which provides light beams as lighting source with benefit of energy saving, environmental friendly, longer life, less light flicking or flashing, the LED lamp shall use the existing and/or traditional lighting fixtures. A drawback, however, associated with a typical LED lamp is that it usually delivers a directional light, also known as light forward or forward light cone. A reason that an LED lamp gives off light in one direction is that an LED lighting apparatus is a forward illuminating light source. For example, the existing LED bulb lamp uses a planar LED circuit board with one or more LED dies affixed to the circuit board, which generates light generally concentrating in a direction opposite to the circuit board. Directional lighting general leads to insufficient light coverage in other directions. Consequently, conventional LED lamps often fail to comply with certain luminous flux standards which measure typical lighting fixtures' light illumination and/or delivery.

SUMMARY

A solid-state light fixture capable of emitting omnidirectional illumination using light emitting diode ("LED") is disclosed. The light fixture, in one aspect, includes a base, an LED stand, and a protective shell. In one example, the LED stand has a physical configuration of elongated spherical shaped ball for hosting LED devices. While the base has electrical contacts that are able to connect to electrical power supply for drawing electricity, the elongated spherical shaped ball is configured to distribute electrical current from the base to the LED devices for generating omnidirectional optical light. The LED devices, also known as LED packages, include LED dies configured to be arranged on the surface of the LED stand for light emanating. The protective shell, in one example, protects the LED stand from being contacted by foreign object.

In one embodiment, omnidirectional illumination, which is also known as all-dimensional lighting without dark spot, can be provided by a solid-state lighting fixture such as an LED lamp. In one example, the LED lamp includes a lamp housing, a lamp cap, and a radiating column. The lamp housing includes a globe holder or shell and is coupled to the lamp cap which is also known as the base. The radiating column, which is situated within the lamp housing, is configured to host multiple LED lamp beads or LED dies. The LED lamp beads or LED dies are affixed on a printed circuit board ("PCB") or a flexible self-bonding circuit board.

The LED lamp, in one example, further includes a driving circuit. The driving circuit is configured to manage and control the LED devices mounted on the radiating column. The radiating column, in one embodiment, can be configured into various configurations such as a polygonal prism or ball shaped structure. The LED lamp beads, also known as dies, can be bonded to the top end surface and/or side surface(s) of the radiating column depending on the shapes of the radiating column.

In one embodiment, a PCB and/or flexible self-bonding circuit board is used to host one or more LED dies. Note that one or more LED dies mounted on a PCB forms a LED package or LED device. The driving circuit which is located at a terminal of radiating column is electrically connected with the PCB or flexible self-bonding circuit board for current control. Multiple LED packages are mounted on the top surface and side surfaces of the radiating column. In one aspect, the angle between the top end surface and each side surface of the radiating column has a range from 90 degrees to 120 degrees depending on the physical structures to generate omnidirectional lighting. The light ray emitted from LED lamps overlaps via different angle to generate even lighting whereby omnidirectional illumination without dark spots or black areas can be produced.

It is understood that other aspects of the present invention will become readily apparent to those skilled in the art from the following detailed description, wherein it is shown and described only exemplary configurations of an LED by way of illustration. As will be realized, the present invention includes other and different aspects and its several details are able to be modified in various other respects, all without departing from the spirit and scope of the present invention. Accordingly, the drawings and the detailed description are to be regarded as illustrative in nature.

BRIEF DESCRIPTION OF THE FIGURES

The exemplary aspect(s) of the present invention will be understood more fully from the detailed description given below and from the accompanying drawings of various aspects of the invention, which, however, should not be taken to limit the invention to the specific aspects, but are for explanation and understanding only.

DETAILED DESCRIPTION

Figure 1:
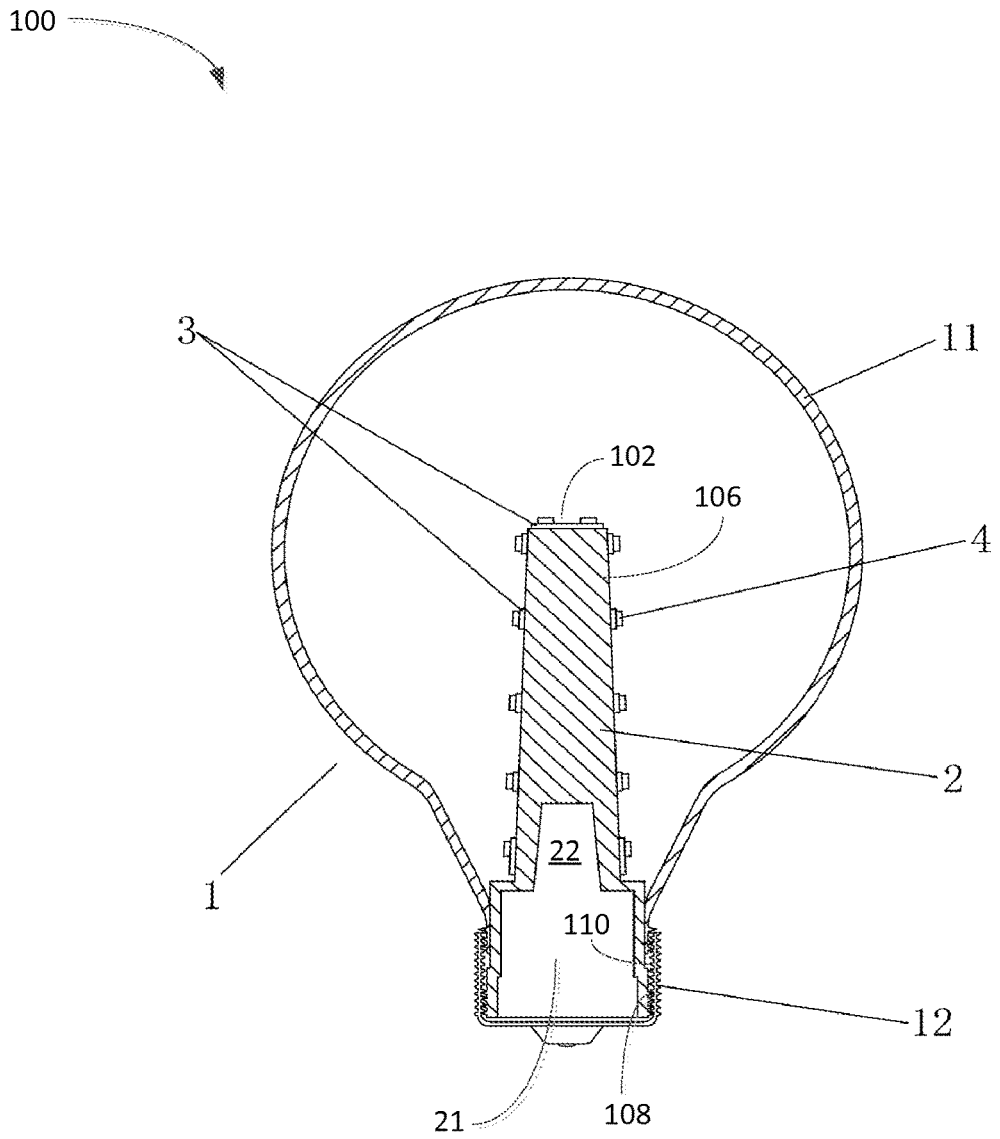
FIG. 1 is a cross-section diagram illustrating an omnidirectional illuminating lamp using LED devices in accordance with an embodiment of the invention.

Embodiments of the present invention are described herein in the context of a method, device, and apparatus of solid-state lightings capable of providing omnidirectional illumination using light emitting diode ("LED") devices.

The present invention is described more fully hereinafter with reference to the accompanying drawings, in which various aspects of the present invention are shown. This invention, however, may be embodied in many different forms and should not be construed as limited to the various aspects of the present invention presented throughout this disclosure. Rather, these aspects are provided so that this disclosure is thorough and complete, and fully conveys the scope of the present invention to those skilled in the art. The various aspects of the present invention illustrated in the drawings may not be drawn to scale. Rather, the dimensions of the various features may be expanded or reduced for clarity. In addition, some of the drawings may be simplified for clarity. Thus, the drawings may not depict all of the components of a given apparatus (e.g., device) or method.

Various aspects of the present invention will be described herein with reference to drawings that are schematic illustrations of idealized configurations of the present invention. As such, variations from the shapes of the illustrations as a result, for example, manufacturing techniques and/or tolerances, are to be expected. Thus, the various aspects of the present invention presented throughout this disclosure should not be construed as limited to the particular shapes of elements (e.g., regions, layers, sections, substrates, etc.) illustrated and described herein but are to include deviations in shapes that result, for example, from manufacturing. By way of example, an element illustrated or described as a rectangle may have rounded or curved features and/or a gradient concentration at its edges rather than a discrete change from one element to another. Thus, the elements illustrated in the drawings are schematic in nature and their shapes are not intended to illustrate the precise shape of an element and are not intended to limit the scope of the present invention.

It will be understood that when an element such as a region, layer, section, substrate, or the like, is referred to as being "on" another element, it can be directly on the other element or intervening elements may also be present. In contrast, when an element is referred to as being "directly on" another element, there are no intervening elements present. It will be further understood that when an element is referred to as being "formed" on another element, it can be grown, deposited, etched, attached, connected, coupled, or otherwise prepared or fabricated on the other element or an intervening element.

Furthermore, relative terms, such as "lower" or "bottom" and "upper" or "top," may be used herein to describe one element's relationship to another element as illustrated in the drawings. It will be understood that relative terms are intended to encompass different orientations of an apparatus in addition to the orientation depicted in the drawings. By way of example, if an apparatus in the drawings is turned over, elements described as being on the "lower" side of other elements would then be oriented on the "upper" side of the other elements. The term "lower", can therefore, encompass both an orientation of "lower" and "upper," depending of the particular orientation of the apparatus. Similarly, if an apparatus in the drawing is turned over, elements described as "below" or "beneath" other elements would then be oriented "above" the other elements. The terms "below" or "beneath" can, therefore, encompass both an orientation of above and below.

Unless otherwise defined, all terms (including technical and scientific terms) used herein have the same meaning as commonly understood by one of ordinary skills in the art to which this invention belongs. It will be further understood that terms, such as those defined in commonly used dictionaries, should be interpreted as having a meaning that is consistent with their meaning in the context of the relevant art and this disclosure.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. The term "and/or" includes any and all combinations of one or more of the associated listed items As used herein, the term "light fixture" shall mean the outer shell or housing of a luminaire. The term "luminaire" shall mean a light fixture complete with a light source and other components (e.g., a fan for cooling the light source, a reflector for directing the light, etc.), if required. The term "LED luminaire" shall mean a luminaire with a light source including one or more LEDs.

It is further understood that the aspect of the present invention may contain integrated circuits that are readily manufacturable using conventional semiconductor technologies, such as CMOS ("complementary metal-oxide semiconductor") technology, or other semiconductor manufacturing processes (this invention does not contain integrated circuits, CMOS, etc). In addition, the aspect of the present invention may be implemented with other manufacturing processes for making optical as well as electrical devices. Reference will now be made in detail to implementations of the exemplary aspect(s) as illustrated in the accompanying drawings. The same reference indicators will be used throughout the drawings and the following detailed description to refer to the same or like parts.

One embodiment of the present invention discloses a solid-state light fixture capable of generating omnidirectional illumination using light emitting diode ("LED") devices. The light fixture, in one aspect, includes a base, an LED stand, and a protective shell. In one example, the LED stand has a physical configuration of elongated spherical shaped ball for hosting LED devices. While the base has electrical contacts that are able to connect to electrical power supply for drawing electricity, the elongated spherical shaped ball is configured to distribute electrical current from the base to the LED devices for generating omnidirectional optical light. The LED devices, also known as LED packages, include LED dies configured to be arranged on the surface of the LED stand for light emanating. The protective shell, in one example, protects the LED stand from being contacted by foreign object.

FIG. 1 is a cross-section diagram 100 illustrating an omnidirectional illuminating lamp using LED devices in accordance with an embodiment of the invention. Diagram 100 shows an omnidirectional or all-dimensional LED bulb lamp without dark spots. The lamp includes a lamp housing 1 wherein lamp housing 1 further includes a shall 11 also known as globe holder and a base 12. Lamp housing 1 is further internally provided with a radiating column 2, LED lamp beads or LED package 4, and a driving circuit. LED package 4 are mounted on a flexible self-bonding circuit board or PCB 3. It should be noted that the underlying concept of the exemplary aspect(s) of the present invention would not change if one or more components (or devices) were added to or removed from diagram 100.

Radiating column 2, in one aspect, can be various different shapes depending on the applications. For instance, radiating column 2 can be a polygonal prism with a predefined set of angles whereby omnidirectional illumination can be achieved. LED lamp beads or LED package 4 are configured to be mounted on top 102 as well as side surface 106 of radiating column 2 using flexible self-bonding circuit board or PCB 3. The driving circuit, in one example, is located at the terminal of radiating column 2 and is electrically connected with the flexible self-bonding circuit board or PCB 3. In one embodiment, the angle range between top surface 102 and side surface 106 of radiating column 2 is set between 90 degrees and 130 degrees based on the applications. Flexible self-bonding circuit board or PCB 3 is constructed to include a mash wiring network used for channeling current to various LED beads or LED package 4.

In one embodiment, base 12 is fabricated with internal threads 110 adaptive to the external threads 108 located at lower terminal of radiating column 2 for electrical connections. The terminal of radiating column 2 also includes an internally-concave cavity 21 which can be used to house the driving circuit. In addition, the terminal of radiating column 2 includes a notch 22 which is used to accommodate an electric wire for electrically connecting the driving circuit with the flexible self-bonding circuit board or PCB 3.

In one example, one (1) or two (2) LED packages or devices are arranged on top surface 102 of radiating column, and two (2) to five (5) LED packages are arranged on each of side surface 106 based on the specific design of radiating column 2. In one aspect, a total of 10 to 40 LED packages (dies plus PCBs) are arranged or deposited on the surface of radiating column 2.

An advantage of employing angled radiating column is to generate sufficient amount of directional light columns whereby the overlap between the light columns due to the angles will generate omnidirectional illumination.

Figure 2:
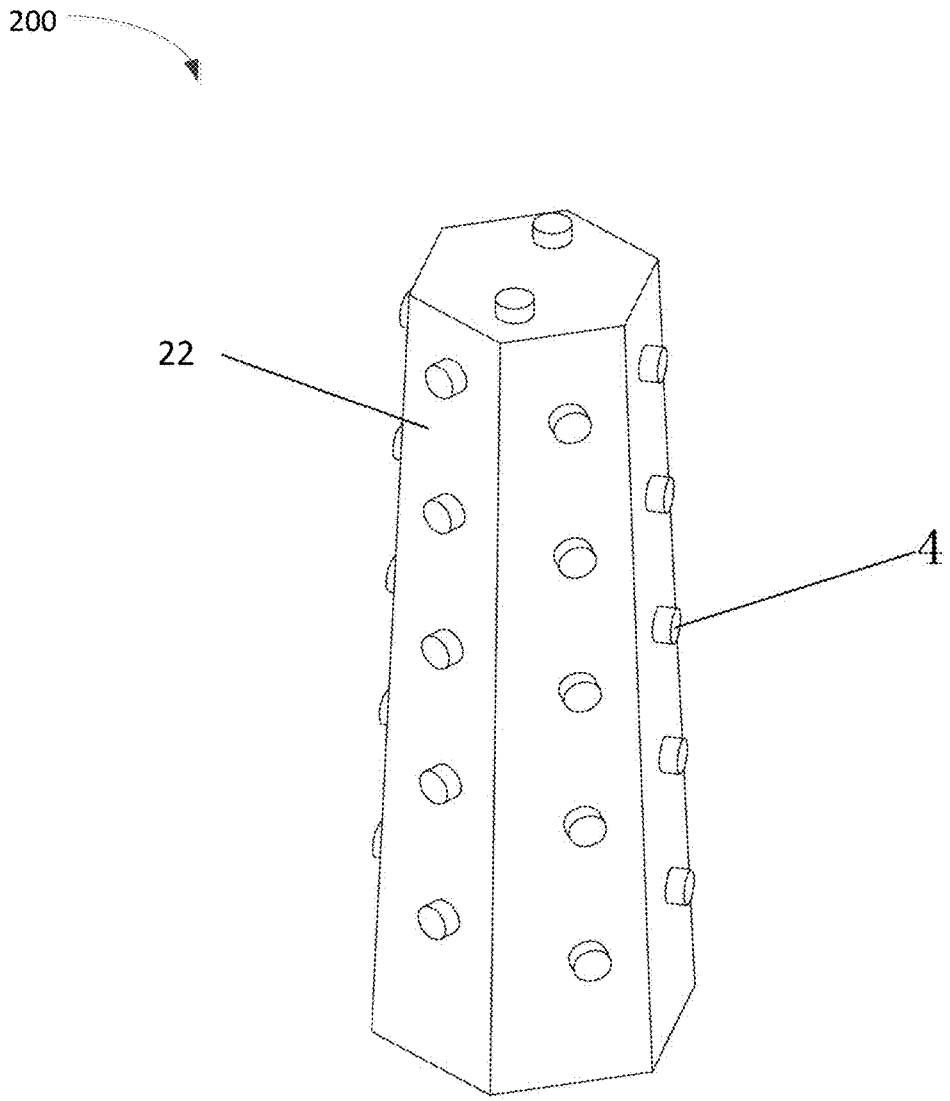
FIG. 2 is a schematic diagram illustrating a radiating column hosting LED dies in accordance with an embodiment of the invention.

FIG. 2 is a schematic diagram 200 illustrating a radiating column hosting LED dies in accordance with an embodiment of the invention. Diagram 200 illustrates a hexagonal prism shaped LED stand or radiating column 22. In one example, two (2) LED packages 4 are mounted on the top surface of radiating column 22 while five (5) LED packages 4 are arranged on each of the six side surfaces with substantially equidistant between LED packages 4. In one aspect, the angle between the top end surface and each of the six side surface of the radiating column 22 is 92 degrees. In one example, the luminous flux which can be generated by the hexagonal prism shaped LED stand with roughly 32 LED packages should be approximately 800 lumen ("lm"). It should be noted that the underlying concept of the exemplary aspect(s) of the present invention would not change if one or more components (or packages) were added to or removed from diagram 200.

Figure 3:
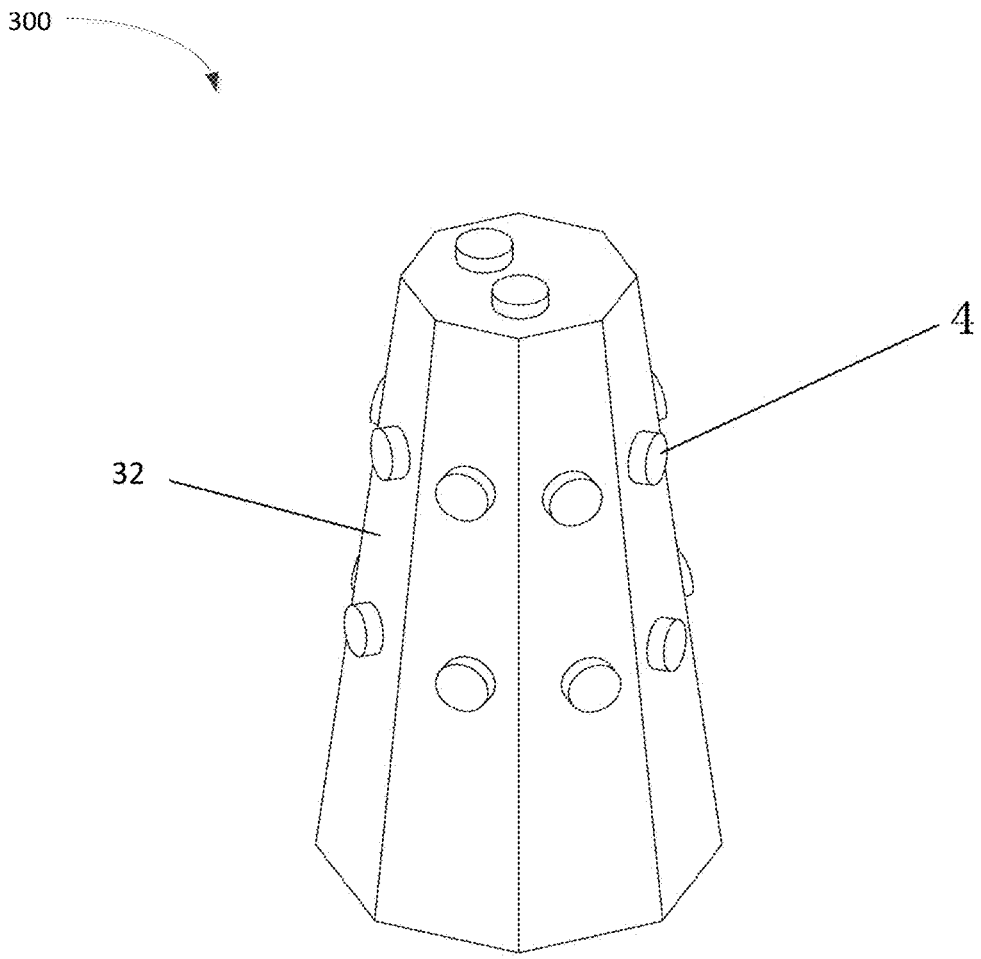
FIG. 3 is a schematic diagram illustrating an alternative configuration of radiating column in accordance with an embodiment of the invention.

FIG. 3 is a schematic diagram 300 illustrating an alternative configuration of radiating column in accordance with an embodiment of the invention. Diagram 300 illustrates an octagonal prism shaped LED stand or radiating column 32. In one example, two (2) LED packages 4 (i.e., lamp beads) are arranged on each of the eight side surface with equidistant from each other. Two (2) LED packages are placed on the top end surface. The angle between the top end surface and each side surface of radiating column 4 is approximately 96 degrees. The luminous flux generated by the octagonal prism shaped LED stand is approximately 500 lm. It should be noted that the underlying concept of the exemplary aspect(s) of the present invention would not change if one or more components (or packages) were added to or removed from diagram 300.

Figure 4:
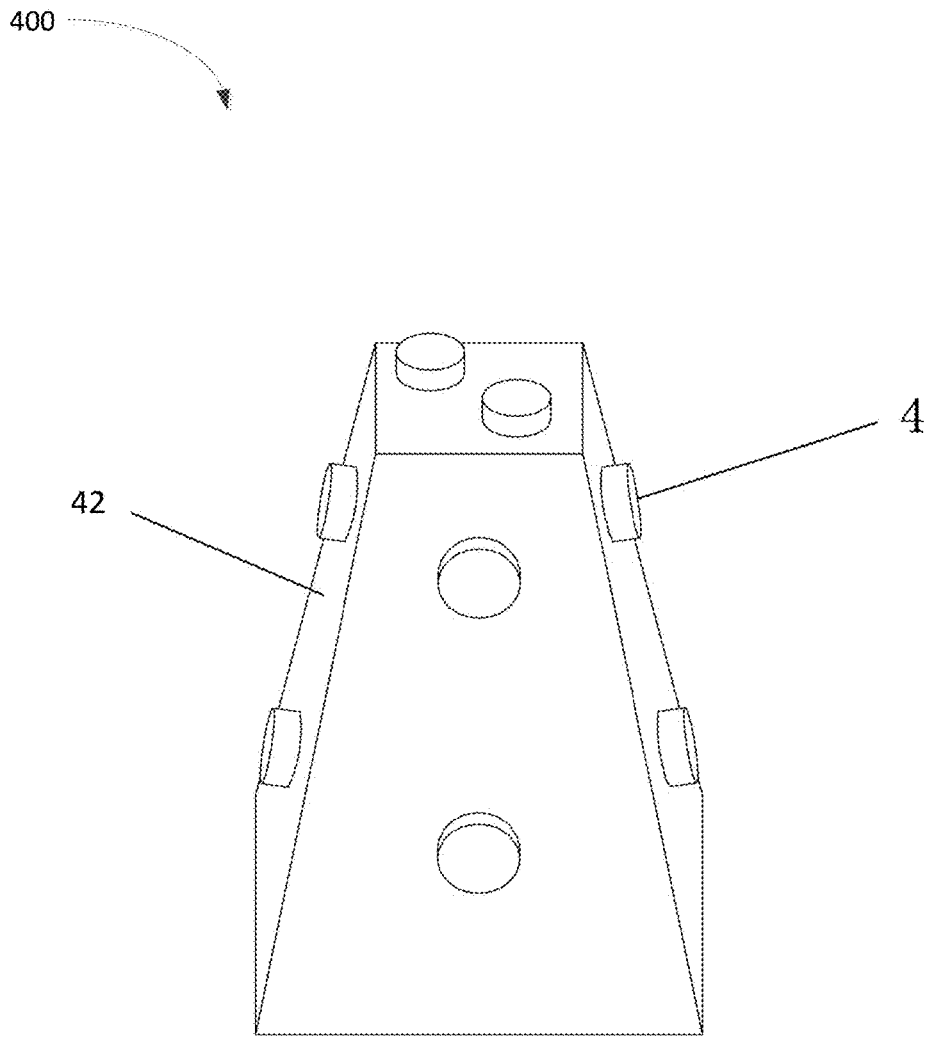
FIG. 4 is a schematic diagram illustrating a square shaped radiating column in accordance with an embodiment of the invention.

FIG. 4 is a schematic diagram 400 illustrating a square shaped radiating column in accordance with an embodiment of the invention. Diagram 400 illustrates a radiating column 42 with a quadrangular prism configuration. In one example, two (s) LED packages 4 are arranged on each of the four side surfaces with equidistant from each other, and two LED packages 4 are arranged on the top end surface of radiating column 42. The angle between the top end surface and each side surface of the radiating column is 100 degrees. The luminous flux that can be generated by the quadrangular prim LED stand or radiating column 42 is 400 lm. It should be noted that the underlying concept of the exemplary aspect(s) of the present invention would not change if one or more components (or packages) were added to or removed from diagram 400.

Figure 5:
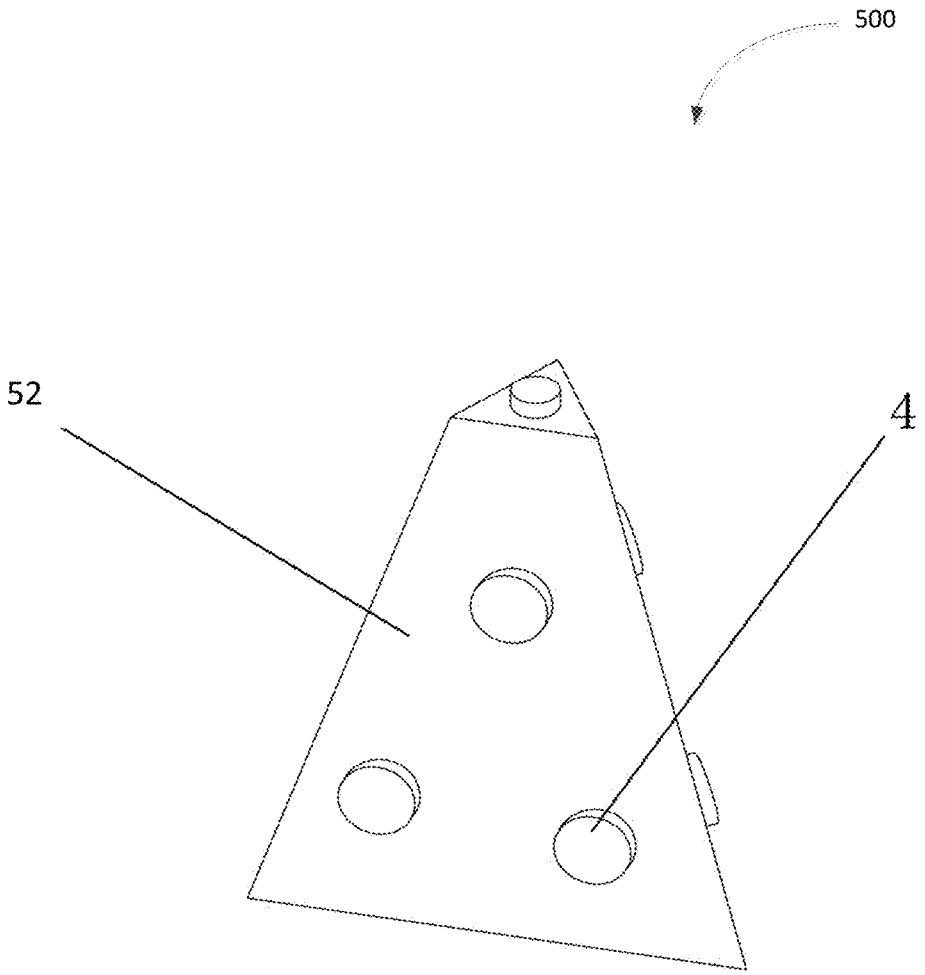
FIG. 5 is a schematic diagram illustrating a triangle shaped radiating column in accordance with an embodiment of the invention.

FIG. 5 is a schematic diagram 500 illustrating a triangle shaped radiating column in accordance with an embodiment of the invention. Diagram 500 illustrates a radiating column 52 having a triangular prism configuration. In one embodiment, three (3) LED packages 4 are arranged on each of the three side surfaces with equidistant from each other. One LED package 4 is arranged on the top end surface. The angle between the top end surface and each side surface of radiating column 52 is approximately 100 degrees. The luminous flux that can be generated by the triangle shaped radiating column 2 is approximately 400 lm.

Figure 6:
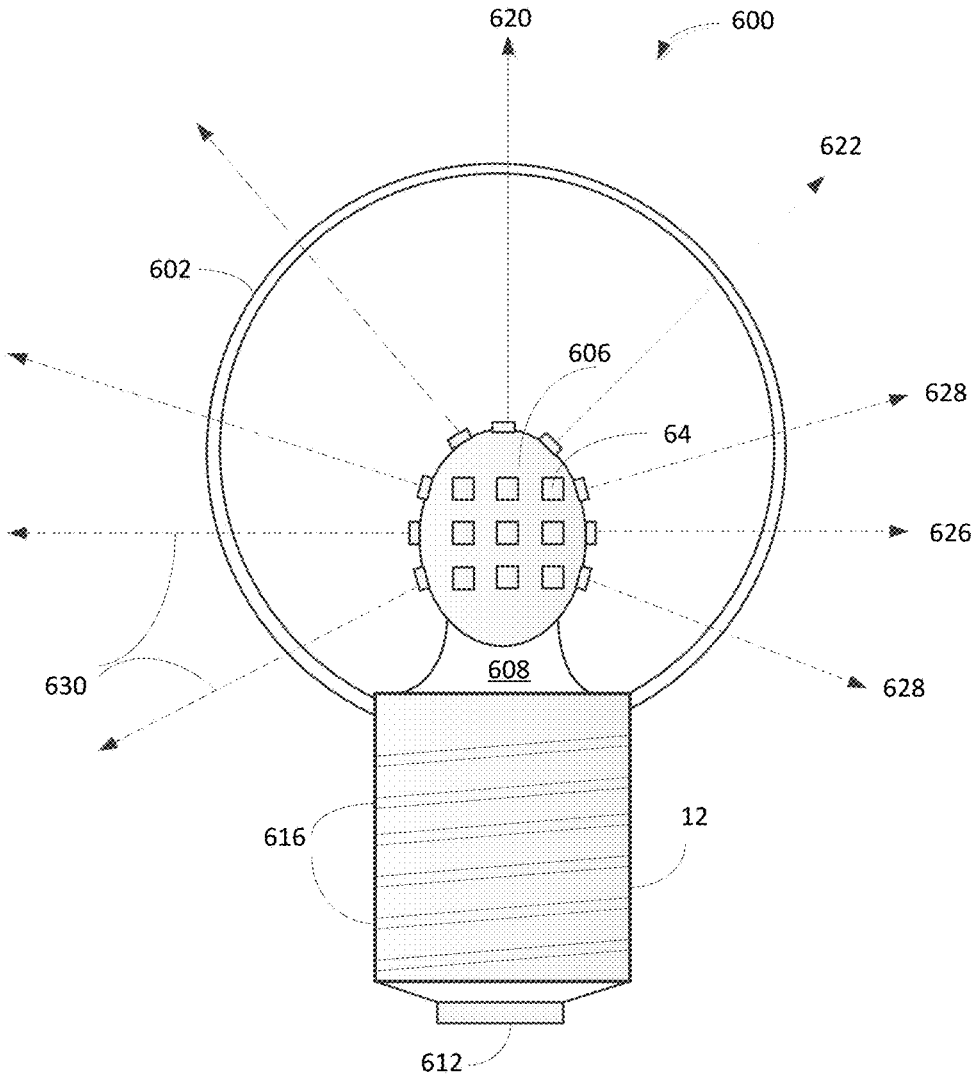
FIG. 6 is a schematic diagram illustrating a lighting device using an elongated ball shaped radiating column in accordance with an embodiment of the invention.

FIG. 6 is a schematic diagram illustrating a lighting device 600 using an elongated ball shaped radiating stand 606 in accordance with an embodiment of the invention. Device 600 includes a lamp cap, also known as a base 62, a shell 602, and an elongated ball shaped radiating stand 606, also known as elongated ball shaped stand, spherical stand, or stand, wherein stand 606 which is also known as spherical mount stage is able to house multiple LED packages 64. Base 62 further includes thread 616 and contact 612 used to couple to the power source. Device 600 may include additional elements such as heat sink(s) for heat dissipation and a column support 608 for anchoring elongated ball shaped radiating stand 606. In one example, base 62 can be a heat sink to dissipate heat from stand 606 to base 62. It should be noted that the underlying concept of the exemplary aspect(s) of the present invention would not change if one or more components (or packages) were added to or removed from device 600.

In one example, column support 608 provides a function of heat dissipation by channeling heat from LED dies to base 12 via stand 606. To facilitate omnidirectional illumination, stand 606 which is configured as a ball or spherical shape is configured to house multiple LED packages 4 in various different angles. Due to the physical shape of stand 606, LED packages 4 are mounted in such a way that combined directional light columns 620-630 generated by LED packages 4 satisfy the requirements of omnidirectional illumination under certain international and/or domestic lighting standards.

Elongated ball shaped radiating stand 606, which provides a spherical mounting surface for LED packages 4, may be made with different types of materials, such as metal, aluminum, copper, nickel, gold, silver, alloy, plastic, polymer, composite, or a combination of aluminum, copper, nickel, gold, silver, alloy, plastic, polymer, and/or composite. In one example, stand 606 may be coated with reflective color, white color, clear color, or metallic reflective substance to minimize shadowing effect. The size of spherical stand 606 and location(s) of LED packages 4 mounted on the surface of stand 606 can be adjusted based on the applications as well as optimized in accordance with certain lighting specifications and regulations.

Figure 7:
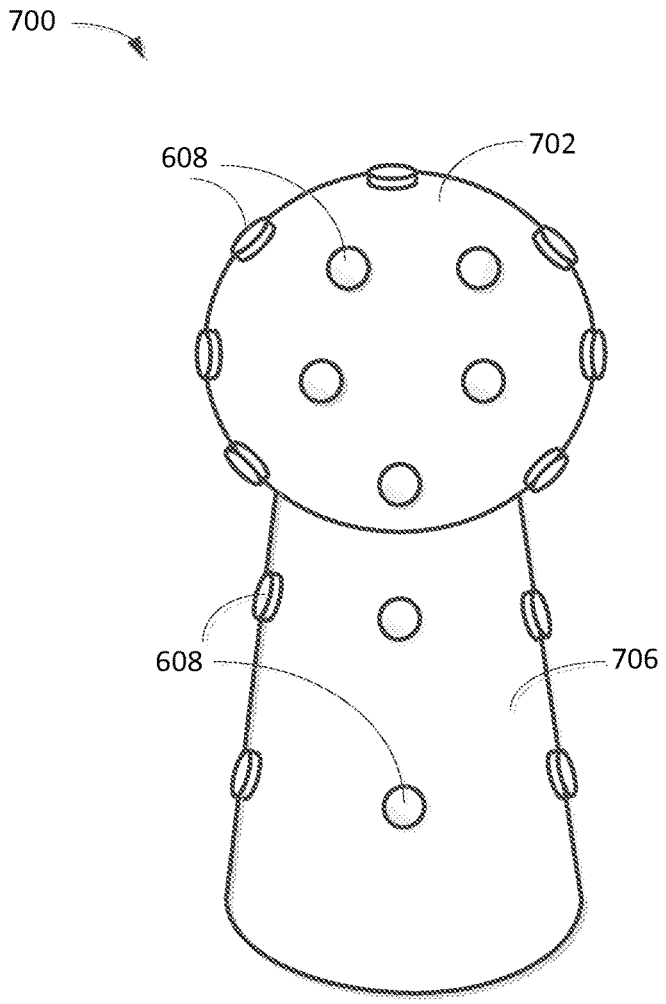
FIG. 7 is a schematic diagram illustrating a ball shaped radiating column in accordance with an embodiment of the invention.

FIG. 7 is a schematic diagram illustrating a ball shaped radiating column 700 in accordance with an embodiment of the invention. Column 700 includes a spherical ball 702 and a cone shaped stand 706, wherein the surface of ball 702 and the surface of stand 706 are used to receive LED packages 4. Depending on the applications, different number of LED packages 4 can be arranged to meet the lighting requirements of the application. Since every LED package 4 will generates a directional beam of light with different angles with its neighboring light beams, omnidirectional illumination is likely to be achieved. It should be noted that the underlying concept of the exemplary aspect(s) of the present invention would not change if one or more components (or packages) were added to or removed from column 700.

Figure 8:
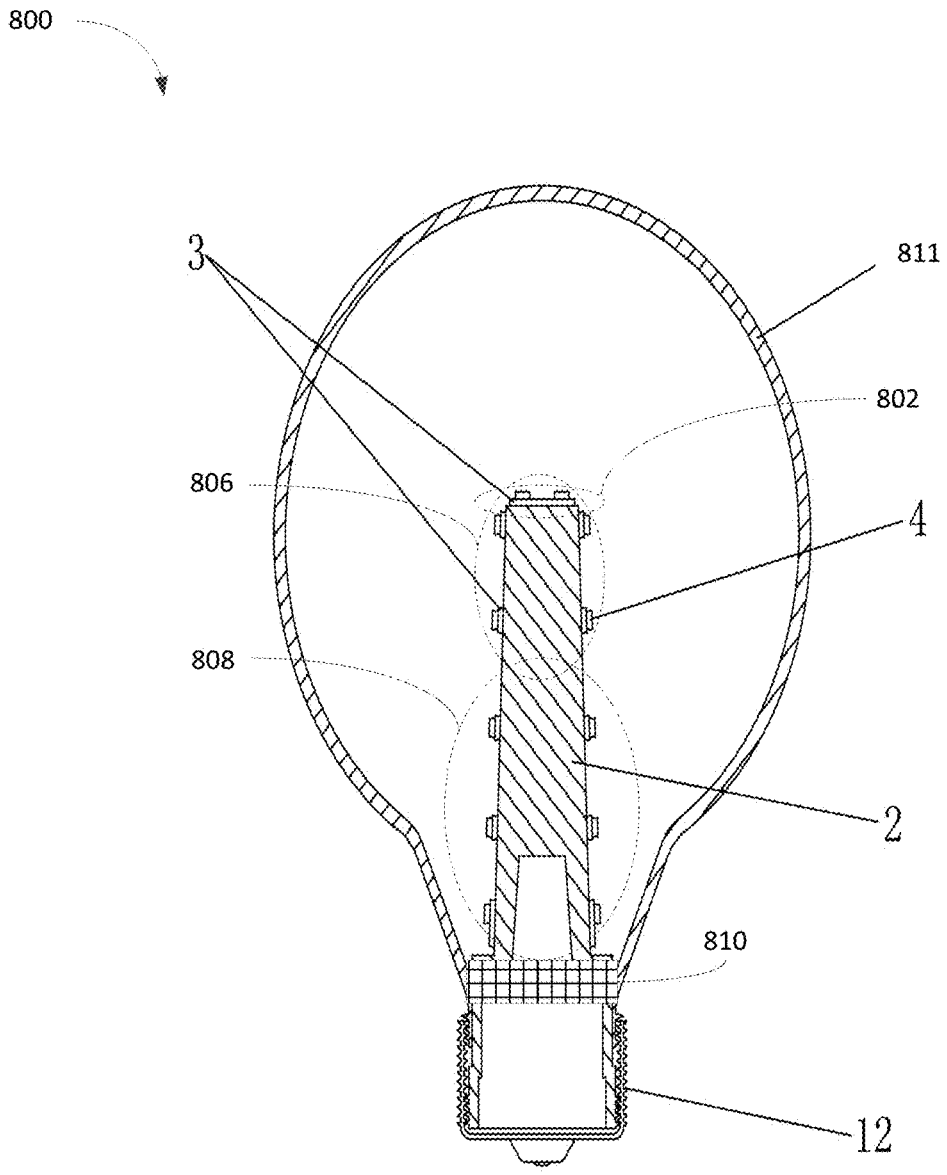
FIG. 8 is a schematic diagram illustrating an LED lamp with control of lighting zones in accordance with an embodiment of the invention.

FIG. 8 is a schematic diagram illustrating an LED lamp 800 with control of lighting zones in accordance with an embodiment of the invention. Lamp 800 includes a base 12, a shell 811, a radiating column 2, and a switch 810. Base 12 is used to draw electrical power for lamp 800 via coupling to a power supply. Shell 811 is coupled to base 12 to protect radiating column 2 from unintended touching or impacting. In one embodiment, various LED packages 4 are attached to the surface of radiating column 2 for generating light. It should be noted that the underlying concept of the exemplary aspect(s) of the present invention would not change if one or more components (or packages) were added to or removed from lamp 800.

Switch 810, in one embodiment, is mechanical manual switch that is capable of switching on or off lighting zones 802-808. For instance, when switch 810 is switched to a first position, all LED packages 4 in zones 802-808 are on. If switch 810 is switched to a second position, zone one (1) 802 is turned on. If switch 810 is switched to a third position, zones one (1) 802 and two (2) 806 are turned on. If switch 810 is switched to a fourth position, zone three (3) 808 is turned on. It should be noted that different zone emits different amount luminous flux. Alternatively, different zone emits different color of light. In one aspect, switch 810 can operate as turning around shell 811 to move from a first switching position to a second switching position.

Figure 9:
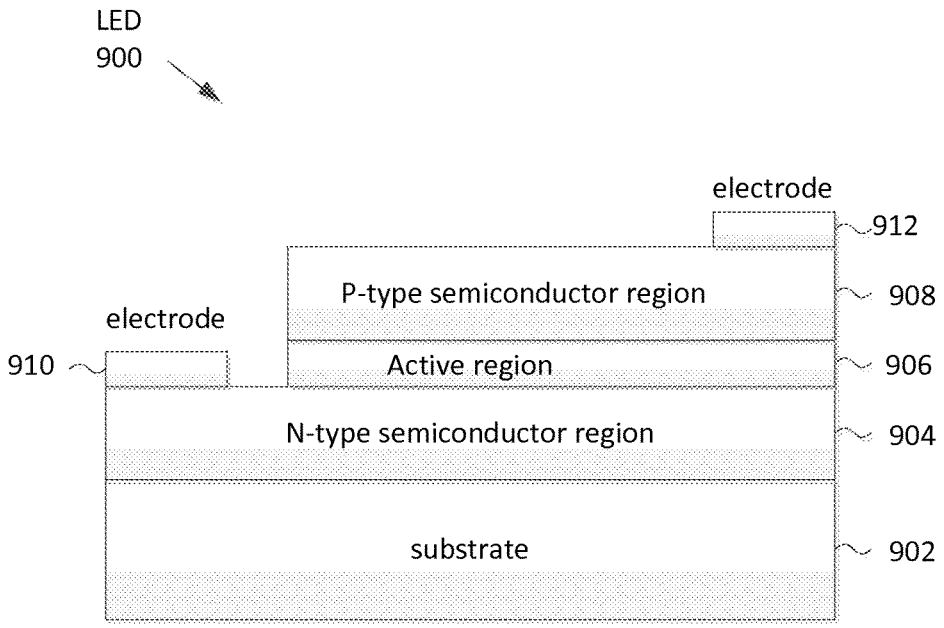
FIG. 9 is a cross-section diagram illustrating a solid-state semiconductor such as an LED in accordance with an embodiment of the invention.

FIG. 9 is a cross-section view of LED 900 illustrating a solid-state semiconductor such as an LED in accordance with an embodiment of the invention. An LED is a semiconductor material impregnated, or doped, with impurities such as "electrons" or "holes". Electrons and holes typically can move within the material based on the potential difference. The doped region of the semiconductor can have electrons or holes and can be referred to as n-type or p-type semiconductor regions. LED 900 includes an n-type semiconductor region 904 and a p-type semiconductor region 908. A reverse electric field is created at the junction between the two regions, which cause the electrons and holes to move away from the junction to form an active region 906 which is also known as an active layer. When a forward voltage sufficient to overcome the reverse electric field is applied across the p-n junction through a pair of electrodes 910-912, electrons and holes are forced into the active region 906 and recombine. When electrons recombine with holes, the optical light is generated due to the energy level changes.

The n-type semiconductor region 904 is formed on a substrate 902 and the p-type semiconductor region 908 is formed on the active layer 906. It should be noted that n-type or p-type regions can be reversed or swapped. That is, the p-type semiconductor region 908 may be formed on the substrate 902 while the n-type semiconductor region 904 may be formed on the active layer 906. Additional layers or regions (not shown) may also be included in the LED 900, including but not limited to buffer, nucleation, contact and current spreading layers or regions, as well as light extraction layers.

The p-type semiconductor region 908 is exposed at the top surface, and the electrode 912 which can be a p-type electrode may be formed thereon. Since the n-type semiconductor region 904 is buried beneath the p-type semiconductor layer 908 and the active layer 906, the n-type electrode 910 is formed on top of the n-type semiconductor region 904. A cutout area or "mesa" is formed by removing a portion of the active layer 906 and the p-type semiconductor region 908 to expose the n-type semiconductor layer 904 there beneath. After this portion is removed, the n-type electrode 910 may be formed.

The various aspects of this disclosure are provided to enable one of ordinary skills in the art to practice the present invention. Various modifications to aspects presented throughout this disclosure will be readily apparent to those skilled in the art, and the concepts disclosed herein may be extended to other LED lamp configurations regardless of the shape or diameter of the glass enclosure and the base and the arrangement of electrical contacts on the lamp. Thus, the claims are not intended to be limited to the various aspects of this disclosure, but are to be accorded the full scope consistent with the language of the claims. All structural and functional equivalents to the elements of the various aspects described throughout this disclosure that are known or later come to be known to those of ordinary skills in the art are expressly incorporated herein by reference and are intended to be encompassed by the claims.

What is claimed is:

1. A light emitting device able to provide illumination, comprising:

a base having electrical contacts to couple to an electrical power supply for drawing electricity;

an elongated spherical shaped ball with a ball stand coupled to the base, and configured to distribute electrical current from the base;

a plurality of light emitting diode ("LED") dies capable of converting electrical energy to optical energy and arranged on the surface of the elongated spherical shaped ball and a surface of the ball stand for emitting omnidirectional light beams; and a protective shell coupled to the base and configured to protect the elongated spherical shaped ball from being contacted by foreign object.

2. The device of claim 1, wherein the elongated spherical shaped ball includes an internally-concave cavity within center portion of the elongated spherical shaped ball for housing a driving circuit.

3. The device of claim 1, wherein the elongated spherical shaped ball is fabricated in heat conductive material so that the elongated spherical shaped ball dissipates heat from the plurality of LED dies to control thermal environment of the plurality of the LED dies.

4. The device of claim 1, wherein the base is made of heat conductive metal for heat dissipation.

5. The device of claim 1, wherein the protective shell is made of composite material capable of facilitating light penetration and heat dissipation.

6. The device of claim 1, wherein the base includes internal threads which adaptively couple to external threads of the elongated spherical shaped ball for electrical coupling between the base and the elongated spherical shaped ball.

7. The device of claim 1, further comprising a switch coupled to the base and configured to control at least a portion of the plurality of LED dies.

8. The device of claim 7, wherein the switch is configured to switch off a least a portion of the plurality of LED dies from emitting light.

* * * * *